US006662373B2

(12) United States Patent
Frank

(10) Patent No.: US 6,662,373 B2
(45) Date of Patent: Dec. 16, 2003

(54) UTILITY VEST WITH UNIVERSAL TOOL POUCH ADAPTER AND METHOD FOR USING SAME

(75) Inventor: Michael L. Frank, Spring Green, WI (US)

(73) Assignee: Advanced Work Products, LLC, Spring Green, WI (US)

( * ) Notice: Subject to any disclaimer, the term of this patent is extended or adjusted under 35 U.S.C. 154(b) by 83 days.

(21) Appl. No.: 10/081,592

(22) Filed: Feb. 22, 2002

(65) Prior Publication Data

US 2003/0159194 A1 Aug. 28, 2003

(51) Int. Cl.[7] ..... A41D 3/02; A45F 4/00

(52) U.S. Cl. ..... 2/94; 2/102; 24/697.1; 24/DIG. 54; 224/583; 224/667; 224/904

(58) Field of Search ..... 2/94, 102, 48, 2/50–51, 93, 85, 247–252, 69.5, 108, 69, 462, 463, 70, 95, 300, 304, 311–319; 24/697.1, 590.1, DIG. 54, DIG. 55, DIG. 56, DIG. 57, DIG. 58, DIG. 59; 224/582, 583, 665, 667, 668, 672, 904

(56) References Cited

U.S. PATENT DOCUMENTS

| | | | | | |
|---|---|---|---|---|---|
| 373,860 | A | * | 11/1887 | Steffey | 24/593.1 |
| 2,636,176 | A | | 4/1953 | Ross | |
| 2,717,391 | A | * | 9/1955 | Bracken | 2/94 |
| 3,438,063 | A | * | 4/1969 | Loston | 2/322 |
| 4,106,121 | A | | 8/1978 | Belson | |
| 4,369,526 | A | | 1/1983 | Clutts | |
| 4,605,335 | A | | 8/1986 | Otrusina | |
| 4,683,595 | A | | 8/1987 | Cash | |
| 5,072,456 | A | | 12/1991 | Elin | |
| 5,341,514 | A | | 8/1994 | Dale | |
| 5,501,379 | A | * | 3/1996 | Munoz | 224/240 |
| 5,604,958 | A | | 2/1997 | Anscher | |
| 5,617,582 | A | * | 4/1997 | Burwell | 2/102 |
| 5,833,095 | A | * | 11/1998 | Russell et al. | 224/576 |
| 5,909,802 | A | * | 6/1999 | Puco et al. | 2/102 |
| 5,957,421 | A | | 9/1999 | Barbour | |
| 5,988,315 | A | | 11/1999 | Crane | |
| 5,991,925 | A | * | 11/1999 | Wu | 2/102 |
| 6,216,931 | B1 | | 4/2001 | Trawinski | |
| 6,398,092 | B1 | * | 6/2002 | Ansley | 224/582 |

* cited by examiner

*Primary Examiner*—Tejash Patel
(74) *Attorney, Agent, or Firm*—Patricia Smith King

(57) ABSTRACT

A utility vest enabling attachment of an at least one tool pouch having a generic tool belt type attachment means and method for employing same is disclosed. The utility vest comprises a vest portion having a back and two front side portions defining two armholes, a neck opening and a reinforced bottom edge along which are spaced a plurality of apertures and, one or more adapter portions comprising a rectangular staking plate on which are mounted two or more attachment means for securing the adapter portions to the reinforced bottom edge of the vest portion by inserting the attachment means into the apertures at a location selected by a user. The staking plate is sized in width to enable a tool pouch having a generic tool belt type attachment means to be fitted thereon prior to attachment of the adapter portion to the vest portion. Tool belt type tool pouches may be thereby attached to the vest at locations to distribute their weight properly so as to minimize strain to the user. The vest is constructed of a strong and durable mesh material to enable ventilation of the user while supporting the weight of the tool pouches and enclosed contents, and may further comprise an insertable girth extender.

23 Claims, 4 Drawing Sheets

UTILITY VEST WITH UNIVERSAL TOOL POUCH ADAPTER AND METHOD FOR USING SAME

BACKGROUND

Workers, tradesmen, sportsmen, hobbyists and others must carry and retain tools or other supplies within easy reach to accomplish their various tasks. Ideally, a means for transporting tools and accessories should minimize strain on the user's back and over-heating, while enabling the user to use readily available tool and accessory pouches.

Tool belts have been used to carry tools and other items and a great many tool pouches and other accessory carriers have been adapted for attachment to them. Unfortunately however, tool belts generally create an uneven strain on the back of the user and are often bulky and uncomfortable to wear. So though using a tool belt may provide a user a wide selection of tool and accessory pouches, it is at a cost to the user's back, legs and general comfort.

Utility vests, by contrast, generally are more comfortable to wear and create less strain on the back and legs of a user. However, these do not provide the user with the wide selection of generic and readily available tool pouches available for use with tool belts, requiring instead that a user purchase pouches with specialized means of attachment to the vest. Additionally, many of the tool vests on the market today, are constructed of leather or heavy canvas materials that have an insulating effect and do not enable a user to cool properly.

Information relevant to attempts to address these problems can be found in U.S. Pat. No. 6,295,650 to Baacke, U.S. Pat. No. 6,216,931 to Trawinski, U.S. Pat. No. 5,988,315 to Crane, U.S. Pat. No. 5,957,421 to Barbour, U.S. Pat. No. 5,072,456 to Elin, U.S. Pat. No. 4,369,526 to Clutts, and U.S. Pat. 4,106,121 to Belson. However, each one of these references suffers from one or more of the following disadvantages:

(a) they provide only limited (and often specialized) means of attaching various tool or accessory pouches and thus do not allow the use of generally available tool belt type pouches, requiring instead that a user invest in a new set of pouches;

(b) they do not minimize strain to a user's back and legs; and, (c) they are insulating and restrict the ability of a user to cool down.

For the foregoing reasons, there is a need for a utility vest that minimizes strain and insulation to a user, while enabling the user to attach to it a wide selection of already available tool and accessory pouches.

SUMMARY

The present invention is directed to a utility vest that satisfies these needs. A utility vest having features of the present invention comprises a vest portion having a back portion and two front side portions defining two armholes, a neck opening and a reinforced bottom edge along which are spaced more than one aperture, and one or more adapter portions. The adapter portions are comprised of a rectangular staking plate on which are mounted two or more attachment means for securing the adapter portion to the reinforced bottom edge of the vest portion by insertion of the attachment means into the apertures at a location selected by a user. The staking plate is sized in width to enable the tool pouch's tool belt type attachment means to be fitted thereon prior to attachment of the adapter portion to the vest portion. In this way, the utility vest will have attached to it one or more tool pouches having a tool belt type attachment means.

In another aspect, the vest portion is comprised of a strong and durable mesh material to enable ventilation of a user while supporting the weight of the tool pouches and their contents.

In another aspect, the apertures include reinforcement grommets to add strength to the apertures and to enable secure attachment of the one or more adapter portions when their attachment means are inserted therein.

In another aspect, the staking plate comprises a rigid material able to hold a slight curve to enable its proper fitting to the bottom edge of the vest portion and may optionally be sized in length to fit the entire length of the bottom edge of the vest portion.

In another aspect, one or more pocket means and pocket attachment means for detachably securing said pocket means to the front side portions of the vest are provided.

In another aspect, an insertable extender portion is provided to extend the girth of the vest portion to enable its fit over heavier clothing.

In another aspect, a method for attaching one or more tool pouches having a tool belt type attachment means to a utility vest is provided, comprising providing a vest portion having a back portion and two front side portions defining two armholes, a neck opening and a reinforced bottom edge along which are spaced more than one aperture; providing one or more adapter portions, having a rectangular staking plate on which are mounted two or more attachment means for securing the adapter portions to the reinforced bottom edge of the vest portion, the staking plate being sized in width to enable the at least one tool pouch having a tool belt type attachment means to be fitted thereon prior to attachment of the adapter portion to the vest portion; fitting the tool belt type attachment means of the tool pouch onto the staking plate of the adapter portion; and, detachably securing the adapter portion and tool pouch fitted thereon to the reinforced bottom edge of the vest by inserting the attachment means in at least two of the apertures at a selected location, thereby attaching to the utility vest one or more tool pouches otherwise adapted for use with a tool belt.

Several objects and advantages of the present invention are:

a) means for attaching tool belt type tool and accessory pouches to a utility vest so as to enable a user of the vest to use their own or other readily available generic tool belt type pouches, thus avoiding the need to purchase pouches with specialized attachment means;

b) means for providing a durable and strong utility vest that optimizes cooling while supporting the weight of attached tool pouches and their contents;

c) means for enabling the easy expansion of a utility vest's girth so as to enable its use over heavy clothing so that access to pockets and pouches remains unobstructed; and, d) means for minimizing strain on the user's back by providing a utility vest instead of a tool belt, the vest allowing attachment of tool pouches at variable locations along its bottom edge so as to distribute weight evenly.

The reader is advised that this summary is not meant to be exhaustive. Further features, aspects, and advantages of the present invention will become better understood with reference to the following description, accompanying drawings and appended claims.

BRIEF DESCRIPTION OF DRAWINGS

For a better understanding of the present invention, reference may be made to the accompanying drawings, in which.

Figure 1:
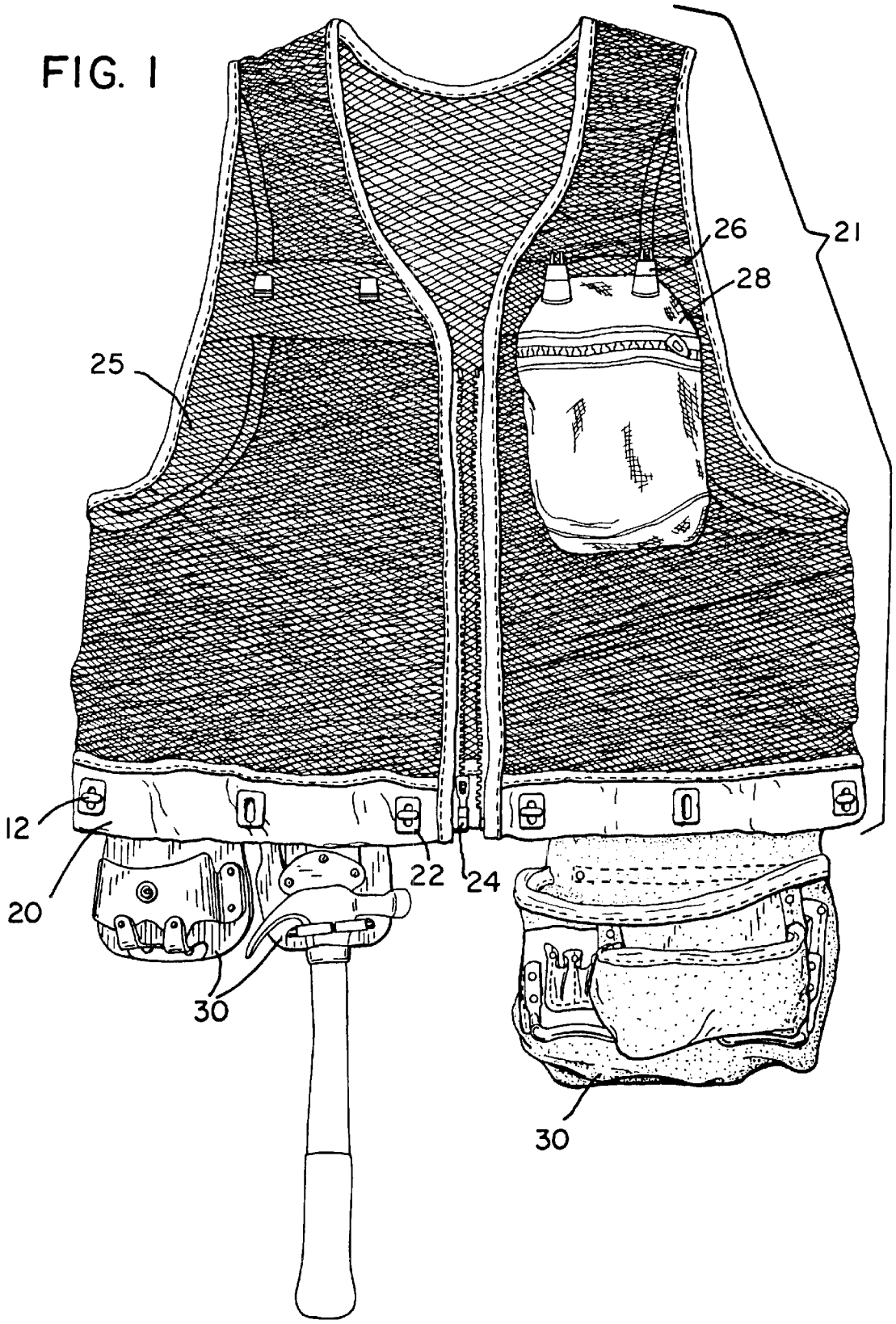
FIG. 1 shows a frontal view of a version of the utility vest with attached tool pouches and optional pocket means.

| Reference Numerals In Drawings: | |
|---|---|
| 10 adapter portion | 12 attachment means of adapter portion |
| 15 staking plate of adapter portion | 20 reinforced bottom edge of vest portion |
| 21 vest portion | 22 aperture with reinforcing grommet |
| 24 attachment means of front sides | 25 mesh material |
| 26 attachment means of pocket | 28 pocket means |
| 29 girth extender portion | 30 tool pouch |

DESCRIPTION

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

It should also be understood that, while the method disclosed herein may be described and shown with reference to particular steps performed in a particular order, these steps may be combined, sub-divided, or re-ordered to form an equivalent method without departing from the teachings of the present invention. Accordingly, unless specifically indicated herein, the order and grouping of the steps is not a limitation of the present invention.

DETAILED DESCRIPTION

Referring to FIG. 1, a frontal view of a version of a utility vest is shown with attached tool pouches 30, optional pocket means 28 and pocket attachment means 26. The utility vest comprises a vest portion 21 and one or more adapter portions 10 (see FIGS. 2 to 4). The vest portion 21 has a back and two front side portions defining two armholes, a neck opening and a reinforced bottom edge 20 along which are spaced several apertures 22.

The two front side portions are detachably secured one to the other by an attachment means 24 that may be a heavy duty zipper as shown or some other form of attachment such as snaps, hook and mesh closures or the like. In one version, the zipper is a one-way zipper to avoid the possibility of the bottom opening while a user is working.

Figure 5:
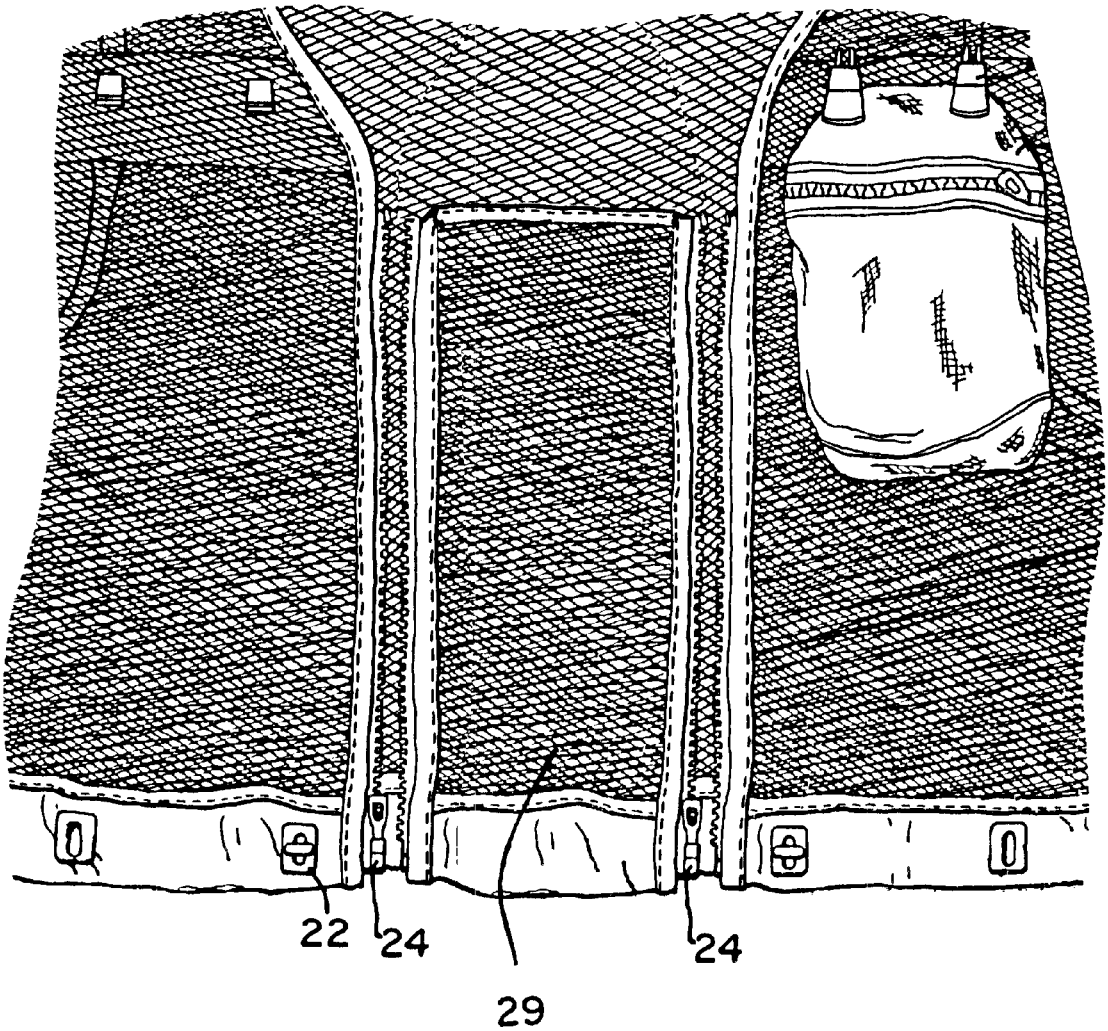

Referring to FIG. 5, the vest portion 21 may further include an insertable girth extender portion 29 to expand its girth. Such a girth extender 29 is made of the same mesh material as the rest of the vest 21 (see below), is basically rectangular in shape but may be slightly wider at its bottom edge, and is attached by insertion between the two front side portions by zipper or other attachment means 24. It may function to enable a wearer to enlarge the girth of the vest when heavier clothing such as jackets are worn, or when the wearer's weight changes. Enabling a wearer to wear the heavier clothing under the vest rather than over it ensures that all tool pouches and pocket means 28 will remain exposed and accessible, even in colder weather.

The vest portion 21 is largely constructed of a mesh material 25 that is strong and durable so as to support the weight of the tool pouches 30 while enabling airflow to ventilate the user. The mesh material 25 may be a plastic material or other like materials including other synthetics that may provide an advantage over natural materials such as cotton or linen, by not absorbing odor-causing perspiration as easily.

The bottom edge 20 of the vest portion is made of a reinforcing material such as a heavy canvas, leather, rubber, plastic, nylon or other like material. The apertures 22 may be likewise reinforced for greater durability by use of reinforcing grommets or the like (as depicted in FIG. 2).

One or more optional pocket means 28 may be provided to enable a user to hold smaller accessories within handy reach. The pocket means 28 are detachably secured to one or both front portions of the vest 21, by pocket attachment means 26. The pocket attachment means 26 may comprise releasable closure mechanisms having normally connected male and female elements respectively attached to a top edge of the pocket means 28 and to a front side portion, and normally joining them together for detachably securing the pocket means 28 to the vest 21. The pocket attachment means 26 may furthermore enable the pocket means 28 to be hingedly connected to the front side portion in order to enable a bottom edge of the pocket means 28 to swing away from the adjacent front panel so that if the user bends over forwardly from the waist, items placed in the pocket means 28 will not fall out and will remain accessible to the user.

Figure 2:
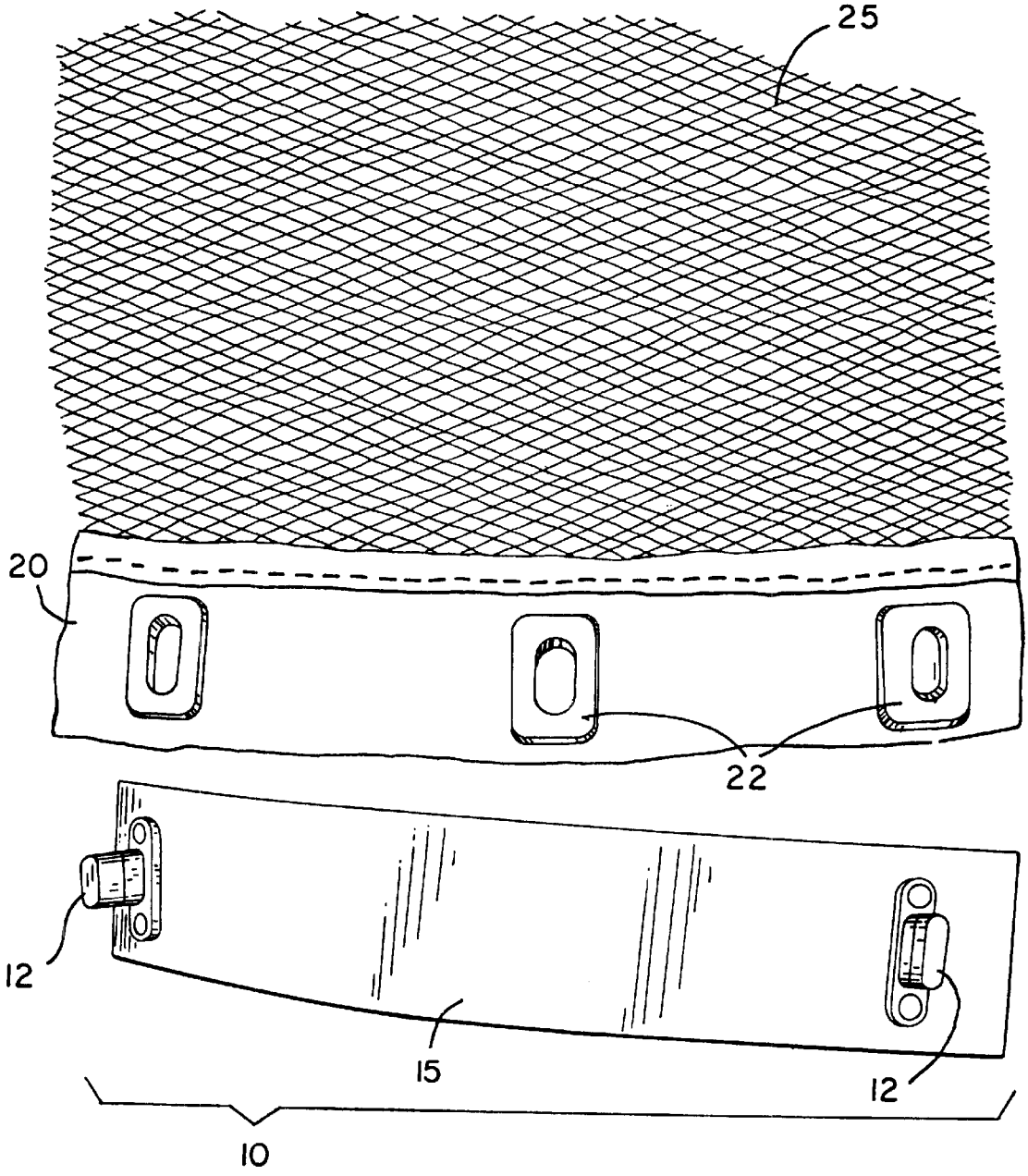
FIG. 2 shows an enlarged view of a portion of the reinforced bottom edge of the utility vest with apertures and adapter portion with latch attachment means.
Figure 3:
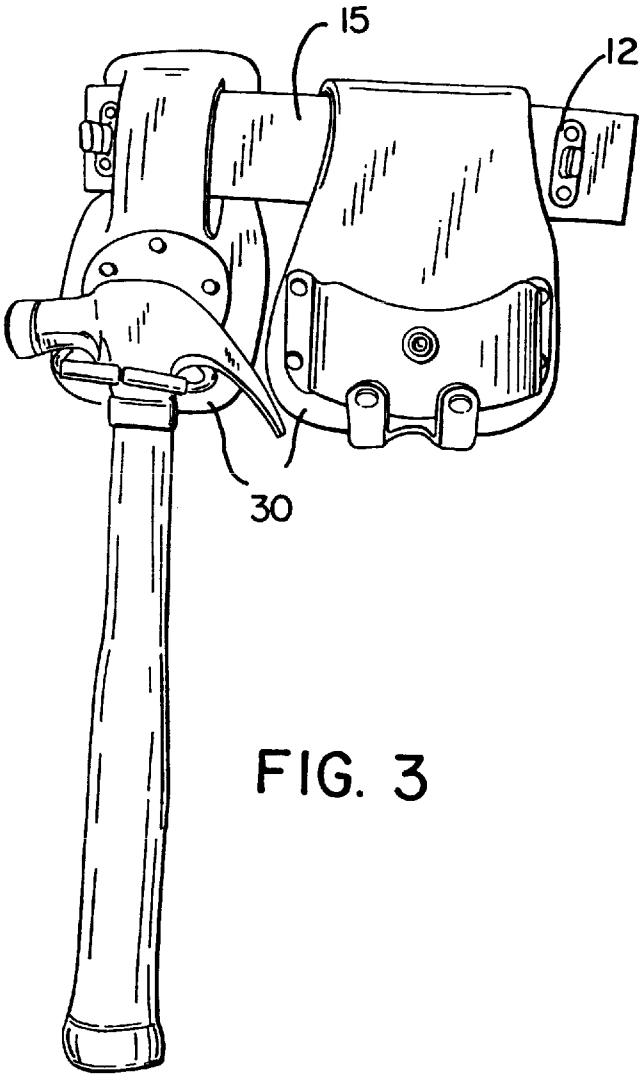
FIG. 3 shows an adapter portion with tool pouches fitted thereto.

Referring to FIGS. 2 and 3, the adapter portion 10 comprises a staking plate 15 having a rectangular shape with a length and a width greater than its height forming a front and a back broader surface and four narrower edge surfaces, the front surface having mounted thereon two or more attachment means 12 for securing the adapter portion to the reinforced bottom edge 20 of the vest portion 21 by insertion of its attachment means 12 into the apertures 22 at a location selected by a user. The user can thereby position the tool pouches 30 to distribute the weight evenly to minimize back and leg strain. The attachment means 12 may be twist latch mechanisms as depicted in FIGS. 1–4 (FIG. 1 showing the latches 12 in the closed position), or other like devices for detachably securing the adapter portions 10 to the bottom edge 20 of the vest. For example, if the attachment means 12 is a twist latch mechanism, the latch is inserted into the aperture 22 when in the open position, then it is twisted to secure the adapter portion 10 to the bottom edge 20. When the latch is again positioned in the open position, the adapter portion 10 may be detached from the bottom edge 20. In this way, the attachment means 12 are used to detachably secure the adapter portion 10 to the bottom edge 20.

Figure 4:
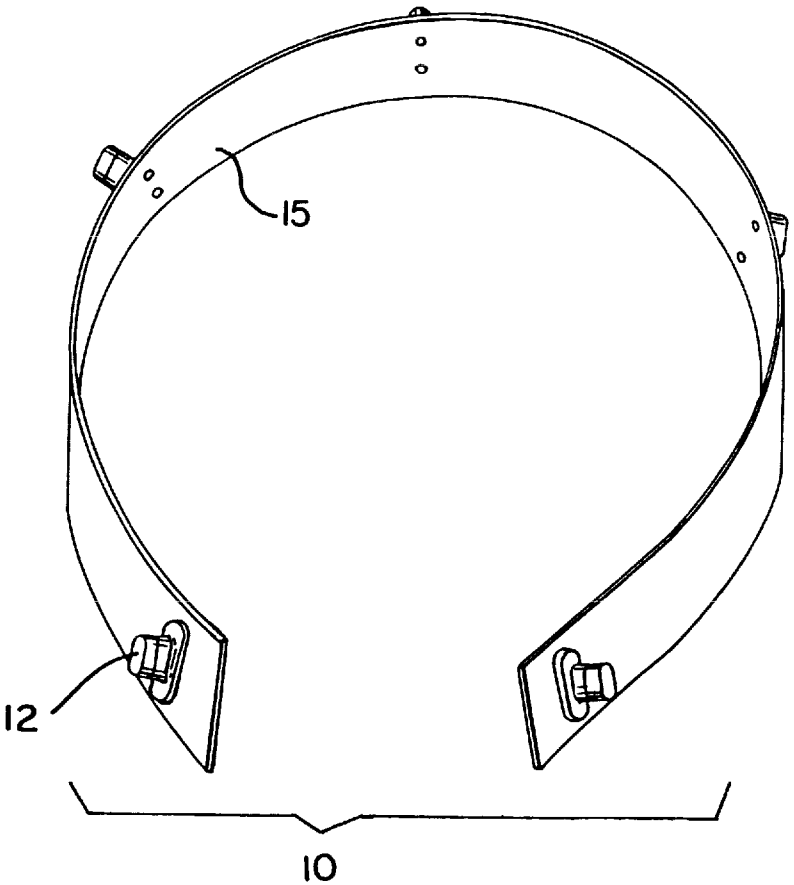
FIG. 4 shows a full-sized version of an adapter portion sized in length to fit the entire reinforced bottom edge of the utility vest; and, FIG. 5 shows a girth extender portion inserted between the two front side portions to extend the girth of the vest portion.

The adapter portion 10 is generally sized in length to allow several to be fitted along the length of the bottom edge 22. However, an alternative version as depicted in FIG. 4 may be employed in which the adapter portion 10 is sized in length to fit the entire bottom edge 20 and contains more than two attachment means 12 distributed along its length.

The staking plate 15 is sized in width to enable a tool pouch 30 having a generic tool belt type attachment means, to be fitted thereon prior to attachment of the adapter portion 10 to the vest portion 21 (see FIG. 3). The staking plate 15 essentially mimics a portion of a tool belt over which the tool pouch 30 is slid as it would be on a tool belt. The staking plate 15 is constructed of a rigid durable material such as a hard plastic and is shaped to curve slightly in order to fit properly to the curve of the bottom edge 20 of the vest portion 21.

HOW THE INVENTION IS USED

The adapter portion 10 is designed to enable readily available tool pouches 30 adapted to be fitted on a tool belt, to fit easily on it. A user simply slips the adapter portion 10 into the tool belt type attachment means of the tool pouch 30, as if it were a portion of a tool belt. Depending on the size of the adapter portion 10 and tool pouches 30 used, one or more tool pouches 30 may be fitted onto an adapter 10 (see FIG. 3, for example of two pouches 30 fitting).

Once an adapter portion 10 is fitted with one or more tool pouches 30, the adapter portion may be detachably secured to the bottom edge 20 of the vest by inserting its attachment means 12 into the apertures 22. In the case of a twist latch attachment means 12, the latch is twisted after insertion to secure the adapter 10 to the vest 21 (as shown in FIG. 1), and twisted back to enable its removal. The user may attach one or more adapters 10 at locations along the bottom edge 20 to distribute the weight of the tool pouches 30 and their content evenly, and to enable access to tools or other accessories of the user's choice. Alternatively, when the full length version of the adapter portion 10 is used (FIG. 4), tool pouches 30 may simply be arranged and spaced along its length to accomplish the same.

Optional pocket means 28 may be attached to one or both of the front side portions of the vest 21 to carry smaller accessories within handy reach of the user. The pocket means 28 may be detachably secured to the front by the pocket attachment means 26.

Once fully assembled, the utility vest may be worn over the clothing of the user to enable easy and unobstructed access to the various tool pouches 30 and pocket means 28 employed. Attaching the optional girth extender by the attachment means 24, enables the user to wear the utility vest over heavier clothing avoiding the need for a user to wear a jacket over the vest which would obstruct access to the pockets 28 and pouches 30.

ADVANTAGES OF THE INVENTION

The previously described versions of the present invention have many advantages, including:

a) means for attaching tool belt type tool and accessory pouches to a utility vest so as to enable a user of the vest to use their own or other readily available generic tool belt type pouches, thus avoiding the need to purchase pouches with specialized attachment means;

b) means for providing a durable and strong utility vest that optimizes cooling while supporting the weight of attached tool pouches and their contents;

c) means for enabling the easy expansion of a utility vest's girth so as to enable its use over heavy clothing so that access to pockets and pouches remains unobstructed; and, d) means for minimizing strain on the user's back by providing a utility vest instead of a tool belt, the vest allowing attachment of tool pouches at variable locations along its bottom edge so as to distribute weight evenly.

The present invention does not require that all the advantageous features and all the advantages need to be incorporated into every embodiment thereof.

CLOSING

Although the present invention has been described in considerable detail with reference to certain preferred versions thereof, other versions are possible. Therefore, the spirit and scope of the appended claims should not be limited to the description of the preferred versions contained herein.

I claim:

1. A utility vest enabling attachment of an at least one tool pouch having a tool belt type attachment means, comprising:

a vest portion having a back portion and two front side portions defining two armholes, a neck opening and a reinforced bottom edge along which are spaced a plurality of apertures; and, an at least one adapter portion comprising a staking plate having a rectangular shape with a length and a width greater than its height forming a front and a back broader surface and four narrower edge surfaces, the front surface having mounted thereon an at least two attachment means for securing the at least one adapter portion to the reinforced bottom edge of the vest portion by insertion of said attachment means in said apertures at a location selected by a user, the staking plate being sized in width to enable the at least one tool pouch having the tool belt type attachment means to be fitted thereon prior to attachment of the adapter portion to the vest portion;

wherein the utility vest will have attached thereto the at least one tool pouch having the tool belt type attachment means.

2. The utility vest of claim 1, wherein the vest portion is comprised of a mesh material through which air may flow to enable ventilation of the user.

3. The utility vest of claim 2, wherein the mesh material comprises a plastic mesh.

4. The utility vest of claim 1, wherein the vest portion is further comprised of a reinforcing material along the bottom edge.

5. The utility vest of claim 4, wherein the reinforcing material is selected from the group consisting of rubber, plastic, nylon, canvas and leather.

6. The utility vest of claim 1, wherein the vest portion further comprises means for detachably securing the two front side portions together.

7. The utility vest of claim 6, wherein the means for detachably securing the two front side portions together comprises a heavy-duty zipper.

8. The utility vest of claim 6, further comprising a girth extender portion to insert between and detachably secure to the two front side portions by the means for detachably securing the two front side portions.

9. The utility vest of claim 1, wherein the plurality of apertures further comprise reinforcing means for strengthening the apertures and enabling secure attachment of the at least one adapter portion when the attachment means are inserted therein.

10. The utility vest of claim 9, wherein the reinforcing means comprise grommets.

11. The utility vest of claim 1, wherein the staking plate comprises a rigid material able to hold a slight convex bend in the front surface to enable its proper fit to the bottom edge of the vest portion.

12. The utility vest of claim 11, wherein the rigid material is a plastic.

13. The utility vest of claim 1, wherein the staking plate of the adapter portion is sized in length to fit the length of the bottom edge of the vest portion.

14. The utility vest of claim 1, wherein the attachment means of the adapter portion comprises a twist latch mechanism that the user may twist after insertion into an aperture for detachably securing the adapter portion to the bottom edge of the vest portion.

15. The utility vest of claim 1, further comprising an at least one pocket means and pocket attachment means for detachably securing said pocket means to the front side portions of the vest.

16. The utility vest of claim 15, wherein the pocket attachment means further enables the at least one pocket means to be hingedly connected to the front side portion to enable a bottom edge of the pocket means to swing away from the adjacent front panel so that if the user bends over forwardly from the waist, items placed in the pocket means will not fall out and will remain accessible to the user.

17. The utility vest of claim 15, wherein the pocket attachment means comprise releasable closure mechanisms having normally connected male and female elements respectively attached to a top edge of said pocket means and to said front side portion, and normally joining the elements together for detachably securing the pocket means to the front side portion.

18. A method for attaching an at least one tool pouch having a tool belt type attachment means to a utility vest, comprising:

providing a vest portion comprising a back portion and two front side portions defining two armholes, a neck opening and a reinforced bottom edge along which are spaced a plurality of apertures;

providing an at least one adapter portion comprising a staking plate having a rectangular shape with a length and a width greater than its height forming a front and a back broader surface and four narrower edge surfaces, the front surface having mounted thereon an at least two attachment means for securing the at least one adapter portion to the reinforced bottom edge of the vest portion by insertion of said attachment means in said apertures at a location selected by a user, the staking plate being sized in width to enable the at least one tool pouch having the tool belt type attachment means to be fitted thereon prior to attachment of the adapter portion to the vest portion;

fitting the tool belt type attachment means of the at least one tool pouch onto the staking plate of the adapter portion; and, detachably securing the adapter portion and the at least one tool pouch fitted thereon to the reinforced bottom edge of the vest portion by inserting said at least two attachment means in at least two of the apertures at a selected location;

thereby attaching to the utility vest the at least one tool pouch otherwise adapted for use with a tool belt.

19. The method of claim 18, wherein the vest portion is comprised of a mesh material through which air may flow to enable ventilation of the user.

20. The method of claim 18, wherein the vest portion further comprises means for detachably securing the two front side portions together.

21. The method of claim 20, further comprising inserting a girth extender portion between the two front side portions and detachably securing the girth extender to the two front side portions by employing the means for detachably securing the two front side portions.

22. The method of claim 18, wherein detachably securing the adapter portion to the bottom edge of the vest portion comprises twisting the adapter portion, the adapter portion comprising a twist latch mechanism.

23. The method of claim 18, further comprising providing an at least one pocket means and pocket attachment means for detachably securing said pocket means to the front side portions of the vest.

* * * * *